US006527107B2

(12) United States Patent
Lamberti et al.

(10) Patent No.: US 6,527,107 B2
(45) Date of Patent: Mar. 4, 2003

(54) ELEVATED CONVEYOR FOR SHEETS

(75) Inventors: Fausto Lamberti, Milan (IT); Fabio Moretto, Oleggio (IT); Gian Piero Spalazzo, Sali Vercellese (IT); Giancarlo Masini, Galliate (IT)

(73) Assignee: Civiemme S.p.A., Bogogno (IT)

( * ) Notice: Subject to any disclaimer, the term of this patent is extended or adjusted under 35 U.S.C. 154(b) by 78 days.

(21) Appl. No.: 09/852,363

(22) Filed: May 10, 2001

(65) Prior Publication Data

US 2001/0040333 A1 Nov. 15, 2001

(30) Foreign Application Priority Data

May 12, 2000 (IT) ..... MI00A1055

(51) Int. Cl.[7] ..... B65G 21/00; B65G 41/00
(52) U.S. Cl. ..... 198/860.1; 198/842
(58) Field of Search ..... 198/860.1, 860.2, 198/842, 837

(56) References Cited

U.S. PATENT DOCUMENTS 5,186,314 A * 2/1993 Clopton ..... 198/841
5,289,913 A * 3/1994 Fujio et al. ..... 198/780
5,562,202 A * 10/1996 Newcomb et al. ..... 198/860.1

FOREIGN PATENT DOCUMENTS

| | | | | |
|---|---|---|---|---|
| DE | 4240664 | * | 9/1994 | ..... 198/860.1 |
| JP | 63-165212 | * | 7/1988 | ..... 198/860.1 |
| JP | 6-16216 | * | 6/1994 | ..... 198/860.1 |

* cited by examiner

*Primary Examiner*—Christopher P. Ellis
*Assistant Examiner*—Mark A. Deuble
(74) *Attorney, Agent, or Firm*—Kirschstein, et al.

(57) ABSTRACT

Elevated conveyor for paper sheets, comprising a framework formed from two vertically arranged supports, it being the case that the vertical supports have horizontally spaced-apart bearing means which have rollers and guide arrangements for transporting belts, and the vertical supports of the transporting arrangement comprise profiles which have guide grooves in the form of dovetail grooves along the peripheral sides, it being the case that said grooves extend over the entire length of the support, and projecting from the circumference of the horizontally arranged bearing means are connecting plates which enclose two opposite sides of a support, and dovetail-form connecting tongues project from the plate surfaces which are directed toward the respective support, and said connecting tongues can be introduced into the grooves of the supports and are connected to the threaded part of a tightening screw which is fastened on the bearing plate.

2 Claims, 3 Drawing Sheets

ELEVATED CONVEYOR FOR SHEETS

The present invention relates to an elevated conveyor for transporting paper sheets.

It is known from the prior art, for the purpose of conveying sheets, to use transporting arrangements designed specifically for this purpose.

Said transporting arrangements usually comprise transporting belts or roller conveying arrangements which are arranged in a horizontal plane; provided for the transportation of the sheets in a vertically arranged plane are transporting sections which are provided specifically for this purpose.

The horizontally arranged transporting paths are usually arranged above the floor-level plane on which the printing machine is accommodated.

It is frequently the case that sub-sections of the horizontally arranged transporting arrangement are also provided in higher-level planes -above the printing machines.

In order to convey the sheets from the horizontal transporting section arranged above the floor to the conveying sections which are arranged in a higher-level plane above the printing machine, and are usually equipped as elevated conveying arrangements, it is essential to provide connecting sections for the intermediate transportation of the sheets in a vertical plane.

Said vertically arranged transporting arrangements, as have been disclosed from the prior art, comprise a framework with a vertical axis, and the framework accommodates at certain intervals, which are defined at the manufacturer's, conveying apparatuses which comprise circumferentially extending bearing means and have transversely arranged retaining struts which are arranged in a horizontal plane.

The struts, which are arranged in a horizontal plane, accommodate groups of rollers and guide arrangements for the conveying belts, which are arranged for the quick transportation of the imbricated sheets from a bottom, horizontal plane to a top plane.

Provided in the top plane is an elevated conveying arrangement which extends above the printing machine.

The known, mechanical arrangements for realizing vertically arranged transporting arrangements of the type mentioned comprise vertically arranged supports which accommodate bearing means which are arranged horizontally at regular intervals, which are predetermined at the factory, and consist, for example, of flat material, and the supports of the apparatus run round in the circumferential direction.

In the known apparatuses, the flat profiles are fixed to the supports, e.g. using a welding operation.

By virtue of connecting the flat profiles to the supports of the vertically running transporting arrangement using a welding process, it becomes clear that, prior to completion of the transporting arrangement running in a vertical plane, it is essential for the dimensions of the vertical transporting arrangement to be defined accurately at the manufacturer's and, in the process, for account to be taken of the precise dimensions of the format of the sheets which are to be transported.

Since it is not possible, in the known arrangements, to change the mutual spacing of the bearings, arranged in horizontal planes, in an adjustment operation, it will not be possible either for sheets of different dimensions to be transported by vertical transporting arrangements designed in this way.

In addition, it will not be possible either to use a modular design for the production of the vertically arranged transporting arrangements, which means that it is necessary to provide, for each sheet-conveying arrangement, a vertically running transporting arrangement which has to be produced at the factory, assembled and adjusted fully in dependence on the format.

It is an object of the present invention to avoid the disadvantages of the prior art and to propose a transporting apparatus of the abovementioned type which extends in a vertical plane, is of modular construction, allows the individual bearing means to be arranged quickly in different, horizontal planes, and permits adaptation to the dimensions of the sheet formats in order that it is also possible for sheets of different dimensions to be transported reliably by the vertical conveying arrangement.

A further object of the invention is to propose a means which allows precise adjustment of the position of the individual horizontally arranged components in relation to the supports of the arrangement.

According to the invention, this object is achieved by a vertically arranged conveying arrangement for sheets, comprising vertically arranged supports which have horizontally spaced-apart bearing arrangements with groups of rollers and guide means for moving the transporting belts, and the conveying arrangement is defined in that the supports of the vertical transporting arrangement comprise profile elements which have guide grooves along their side surfaces, in that the guide grooves extend over the entire length of the support, and projecting from the circumference of the horizontally arranged bearing means are connecting plates which enclose a support on two opposite sides, in that connecting tongues project from the plate sides which are directed toward the support, and said connecting tongues can be introduced into the grooves of the supports and are connected to the threaded part of a tightening screw which is connected to the bearing plate.

The subject matter designed in accordance with the invention will now be described in more detail and illustrated, with reference to an exemplary embodiment, in the attached drawings, in which.

Figure 1:
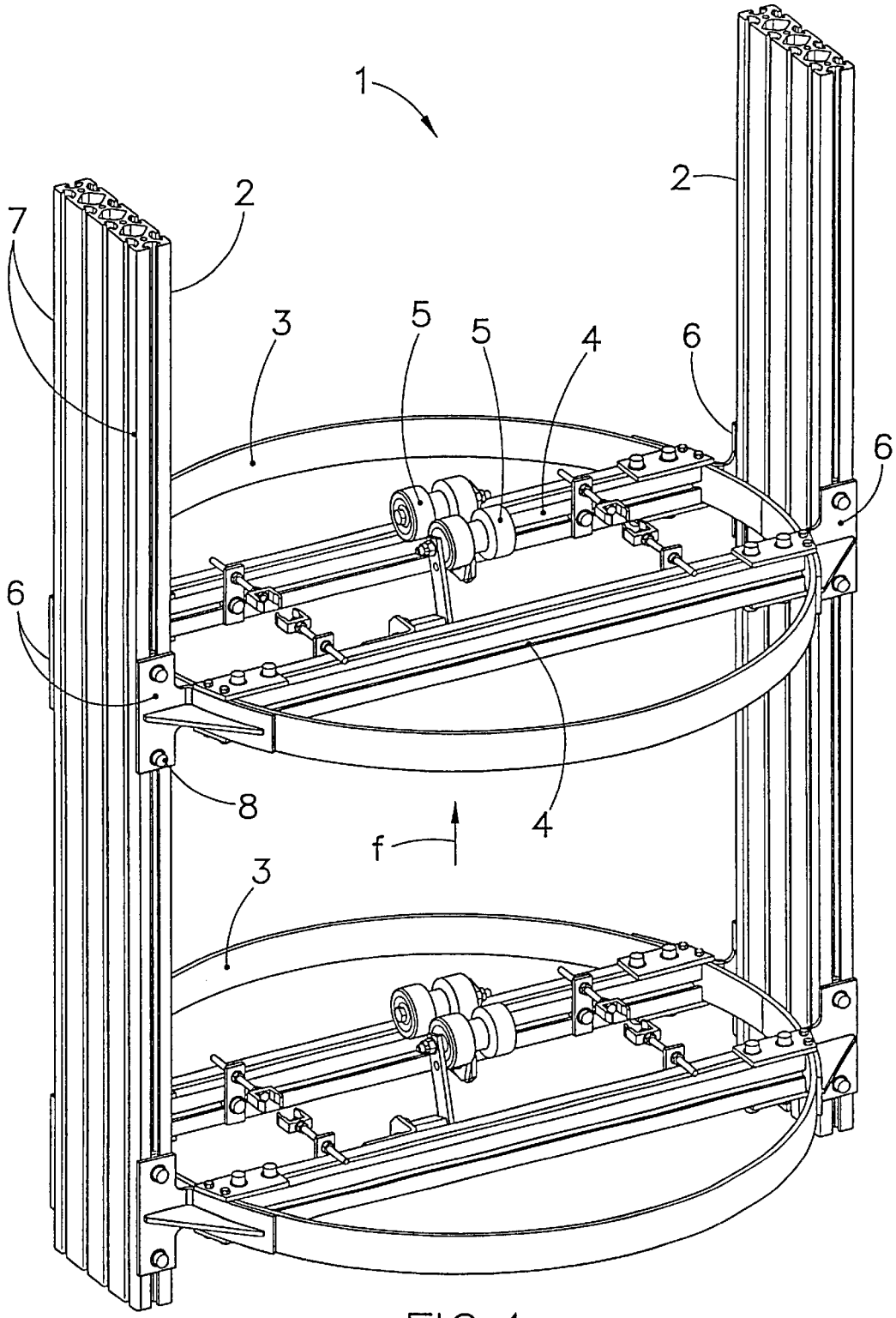
FIG. 1 shows a perspective illustration of part of a vertically arranged transporting arrangement for sheets.

As can be seen from FIG. 1, the vertically arranged transporting arrangement for sheets, which is designated as a whole by 1, comprises two vertically arranged supports.

According to the invention, the supports are designed as hollow profiles with longitudinal grooves 7.

The precise construction of the supports will be described in even more detail hereinbelow.

Provided between the supports are horizontally arranged bearing means 3 which consist of flat or strip material which runs along a circle.

Each bearing means 3, arranged in a circle, accommodates, in the interior, transverse struts which are arranged parallel to one another and are connected to the body of the bearing means 3.

The transverse struts 4 accommodate known guide arrangements for transporting belts and guide rollers 5.

These components are provided in order to guide the sheet stream (not illustrated) continuously from bottom to top, as is illustrated schematically by the arrow (f) in FIG. 1.

FIG. 1 merely shows part of the vertically arranged conveying arrangement. In practice, the vertical supports 2 are of considerably longer length and also accommodate a greater number of bearing means 3.

Each bearing means 3 has projecting plates 6 in the vicinity of each support 2.

It is advantageously always the case that two plates 6 engage around a support. Along its wall sides, the support has grooves 7, which extend over the entire length of a support 2.

The grooves 7 accommodate connecting tongues which interact with screws 8 and are intended for fastening a bearing means 3 with precision in a desired position in relation to the support 2.

Figure 2:
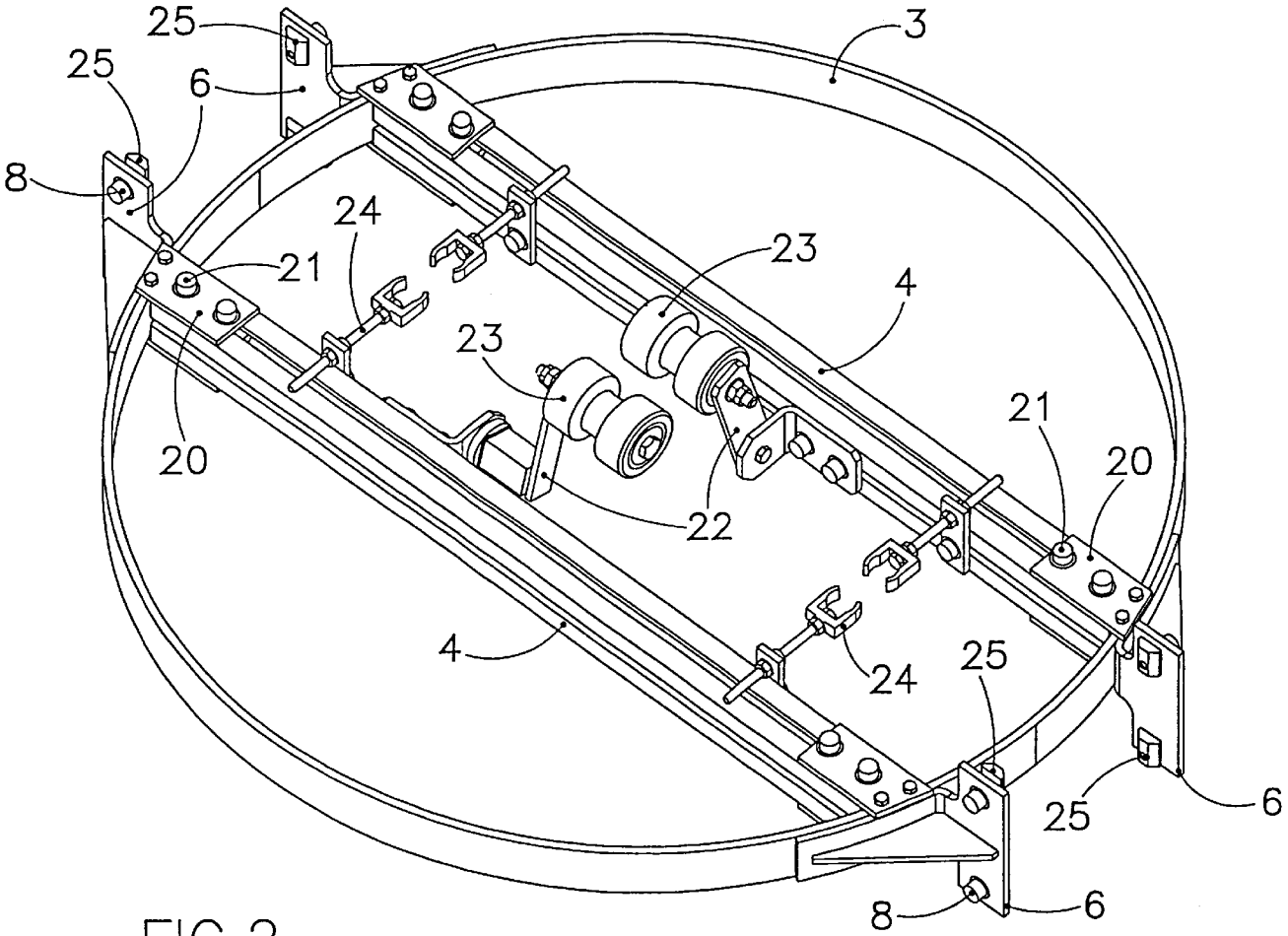
FIG. 2 shows a perspective illustration of a bearing arrangement with guide means and parts for connection to the vertical supports.

FIG. 2 shows a perspective view of a bearing means 3 which comprises, for example, a flat metal strip which is in the form of a circle.

Arranged in the interior of the bearing means 3 are known transverse struts 4, which likewise comprise profile elements.

With the aid of installation plates 20 and screws 21, the transverse struts 4 are connected to the circular bearing body 3.

Pairs of plates 6 project radially outward from the mounting body 7, said plates being provided for determining the position of, and installing, the mount 3.

The spacing between a pair of plates 6 for the installation of the mount 3 is selected such that said spacing corresponds to the width of a support 2.

In the interior of the bearing means 3, the transverse struts 4 accommodate known, adjustable guide arms 22 and guide rollers 23, which are mounted rotatably.

The transverse struts 4 also have adjustable bearing brackets 24 which accommodate vertically arranged guides, e.g. in the form of pieces of tube.

On the inside, the plates 6 have dovetail-form tongue elements 25. Said tongue elements 25 are in operative connection with tightening screws 8.

Figure 3:
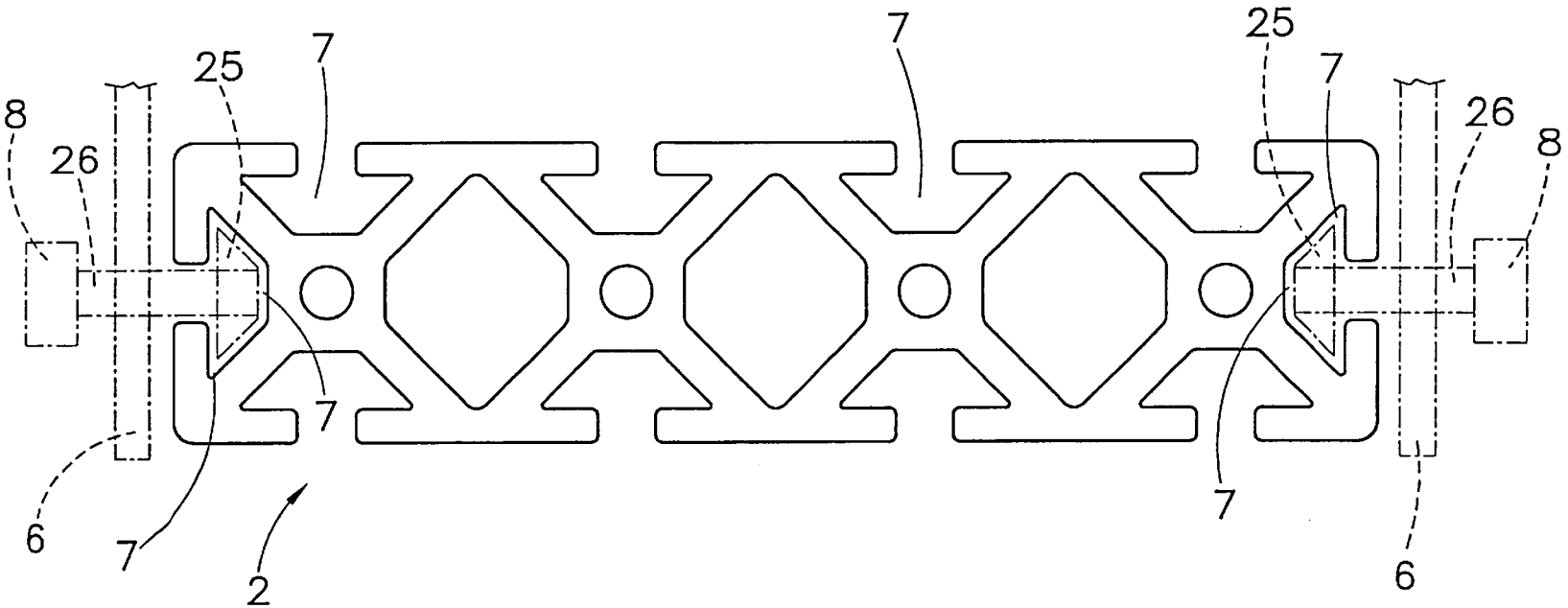
FIG. 3 shows a plan view of the framework of a vertically arranged transporting arrangement according to the invention.

FIG. 3 shows a plan view of a support 2. The support 2 preferably comprises a hollow profile which has longitudinal grooves 7 on its outsides. The grooves are of dovetail form.

In FIG. 3, fastening tongues 25 are inserted into the longitudinal grooves 7 on the narrow sides of the support 2.

The tongues 25 are of dovetail form.

The threaded shank 26 of a tightening screw 8 is screwed into the connecting tongues 25.

Said screw 8 passes through a bore of the plate 6; the plate 6 is connected to the mounting bearing 3 (not illustrated in FIG. 3).

Tightening the screws 8 achieves the situation where the plates 6, and thus the mounting bearing 3, are clamped firmly in the desired position in relation to the supports 2.

By virtue of the provision of the supports 2, which are provided with longitudinal grooves 7 on the side surfaces, it is possible to produce a form-fitting connection between the connecting and guide tongues 25 and the support 2.

The plates 6 for securing the bearings 3 can be clamped firmly in the desired position in relation to the supports 2.

The invention makes it possible to provide a vertical conveying arrangement for transporting sheets, in which case the apparatus can be prepared at the manufacturer's in order then to be installed easily at the location of use.

The bearing bodies 3 may be arranged in various planes, and it is possible, in particular, for the securing means 3 to be adjusted with accuracy and precision in relation to one another in the desired position, in order thus to ensure a satisfactory conveying operation of the sheet stream in the vertical direction.

Furthermore, by dispensing with a weld connection between the supports 2 and the mounting, it is possible, at any time, to adjust the position of the mounting bearings 3 in relation to the supports.

What is claimed is:

1. An elevated conveyor (1) for sheets, comprising vertically arranged supports (2) which accommodate horizontally spaced-apart bearing means (3) and bear rollers and guide arrangements for guiding transporting belts, wherein the supports (2) of the vertically arranged transporting apparatus (1) comprise profile elements (2) which have guide means (7) on the peripheral surfaces, it being the case that the longitudinal grooves (7) extend over the entire length of the supports (2), and projecting from the circumference of the horizontally arranged bearing means (3) are bearing plates (6) which enclose a support (2) on two opposite sides, wherein connecting tongues (25) project from the plate sides (6) which are directed toward the support (2), and said connecting tongues (25) can be introduced into the grooves (7) of the supports (2) and are connected to the threaded part (26) of a tightening screw which is connected to the bearing plate (6).

2. The elevated conveyor for sheets as claimed in patent claim 1, wherein the support (2) is designed as a hollow profile.

* * * * *